US006471827B2

(12) United States Patent
Lumiala et al.

(10) Patent No.: US 6,471,827 B2
(45) Date of Patent: Oct. 29, 2002

(54) METHOD AND DEVICE FOR MEASUREMENT OF THE RETENTION PROFILE AND FOR CONTROL OF THE RETENTION IN A PAPER/BOARD MACHINE

(75) Inventors: Juhana Lumiala, Jyväskylä (FI); Antti Poikolainen, Jyväskylä (FI); Ari Puurtinen, Jyväskylä (FI); Mika Viertola, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/865,102

(22) Filed: May 24, 2001

(65) Prior Publication Data

US 2002/0060016 A1 May 23, 2002

Related U.S. Application Data

(63) Continuation of application No. PCT/FI99/00975, filed on Nov. 25, 1999.

(30) Foreign Application Priority Data

Nov. 26, 1998 (FI) ..... 982560

(51) Int. Cl.[7] ..... D21F 1/02

(52) U.S. Cl. ..... 162/198; 162/263; 162/DIG. 11; 700/129

(58) Field of Search ..... 162/198, 252, 162/253, 258, 259, 262, 264, 263, 337, 351, 380, DIG. 10, DIG. 11; 700/122, 127, 128, 129

(56) References Cited

U.S. PATENT DOCUMENTS 5,022,966 A 6/1991 Hu
5,401,363 A * 3/1995 Begemann et al. ..... 162/164.6
5,545,293 A 8/1996 Huovila et al.
5,552,021 A * 9/1996 Ilvespaa et al. ..... 162/203
5,674,363 A 10/1997 Houvila et al.
5,779,859 A * 7/1998 Carter et al. ..... 192/183
6,086,716 A * 7/2000 Watson et al. ..... 162/198
6,113,741 A * 9/2000 Kettunen et al. ..... 162/158

FOREIGN PATENT DOCUMENTS

| | | |
|---|---|---|
| FI | 901593 | 10/1991 |
| FI | 934884 | 5/1994 |
| FI | 100345 | 11/1997 |
| WO | WO 98/32916 | 7/1998 |

OTHER PUBLICATIONS

Paper Asia, vol. 13, No. 7, Jul. 1997.*
Alkaline Paper Advocate, vol. 1, No. 4, Oct. 1988.*
U.S. patent application No. 09/014,430, *Method and Apparatus for Controlling a Headbox in a Paper Machine.*

* cited by examiner

*Primary Examiner*—Steven P. Griffin
*Assistant Examiner*—Eric Hug
(74) *Attorney, Agent, or Firm*—Lathrop & Clark LLP

(57) ABSTRACT

A sample collecting device takes samples from the white water drained from the web through the wire in the wire part, at a number of points in the cross direction of the web. An analyzer analyses the samples and forms a retention profile for controlling the paper machine. The device for measurement and regulation of the retention profile comprises means for measurement of the retention profile across the web width from different points of width of the web. The headbox comprises ducts passing to different points of width of the headbox to pass a flow of liquid containing a retention agent in the headbox into connection with the stock flow to regulate the retention profile across the web width. The ducts have valves which are regulated on the basis of the retention profile data for regulating the retention agent into duct flow.

24 Claims, 3 Drawing Sheets

METHOD AND DEVICE FOR MEASUREMENT OF THE RETENTION PROFILE AND FOR CONTROL OF THE RETENTION IN A PAPER/BOARD MACHINE

CROSS REFERENCES TO RELATED APPLICATIONS

This application is a continuation of PCT application Ser. No. PCT/FI99/00975 filed Nov. 25, 1999 and claims priority on Finnish application Ser. No. 982560, Filed Nov. 26, 1998, the disclosures of both of which applications are hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a method and a device for measurement and regulation of the retention profile of the web in a paper/board machine.

The invention is related to the dilution liquid system in a paper machine and more specifically to measurement and control of the retention profile of the web in the cross direction of the machine. Further, by means of the device in accordance with the invention, it is possible to locate various situations of malfunction in the wire part of a paper machine or equivalent.

A dilution headbox is known from the applicant's Patent Applications FI-901593, FI-933027 and FI-942780 of earlier dates. In a dilution headbox, the basis weight of the web is regulated so that a dilution flow is passed through a valve to different areas of width of the headbox and so that the quantity of said flow is regulated. The dilution flow is mixed with the stock flow passed from the inlet header of the headbox. As the dilution liquid, it is possible to use pure water or, for example, filtrate water returned from the web. In the applicant's Patent FI 92,229, a construction of a three-way dilution valve is described, which is used for regulation of the dilution flow.

As is known from the prior art, a stock suspension jet is discharged out of the slice opening in paper or board machines onto a forming wire or into a gap between wires. The proportion of the solid matter that remains on the wire, i.e. the retention, consists of a fibre retention, whose proportion is about 60–80%, and of a filler retention, whose proportion is about 20–40%. The filtrate passing through the wire, i.e. the so-called white water, contains an abundance of fibrous material and fillers, and it is returned back to the process of manufacture. By means of measurement of the properties of the white water, information is obtained, among other things, on the success of the dilution regulation. When the measurement is carried out at a number of points in the cross direction, it is possible to conclude the distribution of fibres and fillers in the cross direction of the web. Attempts are made to regulate the retention of fibres and the retention of fillers so that they are distributed as uniformly as possible in the cross direction of the machine.

Factors that affect the retention include, among other things, headbox consistency, construction of the wire part, and properties of the stock, such as distribution of fibre length, fillers, and added chemicals. Measurement of basis weight does not give a correct picture of the retention profile, for with a uniform basis weight profile, the fibre retention profile and the filler retention profile can, nevertheless, be uneven. This is why determination of the retention profile in the wire part would give a correct idea of the retention profiles.

For regulation of the retention, a retention agent is employed, whose function is to bind fillers and fines to the fibres in order that said agents should not depart from the web through the holes provided in the wire. The particle size of fillers and fines is considerably smaller than the size of the holes provided in the wire.

SUMMARY OF THE INVENTION

The object of the invention is to provide a method of measurement for measurement of the retention profile.

An object of the invention is to provide a method of regulation for regulation of the retention profile in the cross direction.

A further object of the invention is to provide a device for measurement of the retention profile.

An object of the invention is to provide a device for regulation of the retention profile.

The method in accordance with the invention is characterized in that, in the method, from the white water drained from the web through the wire in the wire part, samples are taken by means of a sample collecting device from a number of points in the cross direction of the web, preferably at uniform distances, the samples that were taken are analyzed by means of an analyzer, a retention profile is formed out of the measurement results, and the retention profile thus formed is used for controlling the paper machine.

The device in accordance with the invention is characterized in that the device comprises means for measurement of the retention profile across the web width from different points of width of the web out of the white water drained from the wire part, and that the headbox comprises lines passing to different points of width of the headbox so as to pass a flow of liquid that contains a retention agent in the headbox of the paper or board machine into connection with the stock flow so as to regulate the retention profile across the web width, and that the lines comprise, in their connection, a valve construction for regulation of the amount of retention agent into the flow moving in the line, the regulation of the valves taking place on the basis of the measurement data obtained from measurement of the retention profile.

In the present invention, an arrangement is suggested for measurement and regulation of the retention profile in the cross direction of the machine. A white water sample is collected into a sampling vessel and transferred to an analyzer. The analyzer can also be integrated in a measurement head. After taking of the sample and after its transfer to the analyzer, the measurement head is transferred to the following measurement point. With this procedure, the retention profile can be determined across the width of the whole machine direction. Samples can be taken, for example, at intervals of 10 cm in the machine direction.

The determined retention profile is utilized in the regulation of the dilution liquid system, in which connection each dilution liquid valve can be provided with the necessary regulation of the concentration of retention agent. A measurement arrangement accomplished in this way operates as on-line measurement, and it can be carried out constantly during the whole run. The measurement also provides information on problem situations, e.g. on blocking or contamination of the wire fabric, on incomplete mixing of retention agent, or on other situations of failure.

Regulation of the retention profile is carried out so that the basis weight profile is not changed. In such a case, a change in the basis weight of the paper arising from a change in the quantity of retention agent is compensated for by means of a change in the dilution quantity. For example, if a local addition of retention agent increases the basis weight, the dilution quantity at said point is increased.

In the following, the invention will be described in more detail with reference to the exemplifying embodiments of the invention illustrated in the figures in the accompanying drawing, the invention being not supposed to be confined to the details of said embodiments alone.

DESCRIPTION OF THE PREFERRED EMBODIMENTS

Figure 1:
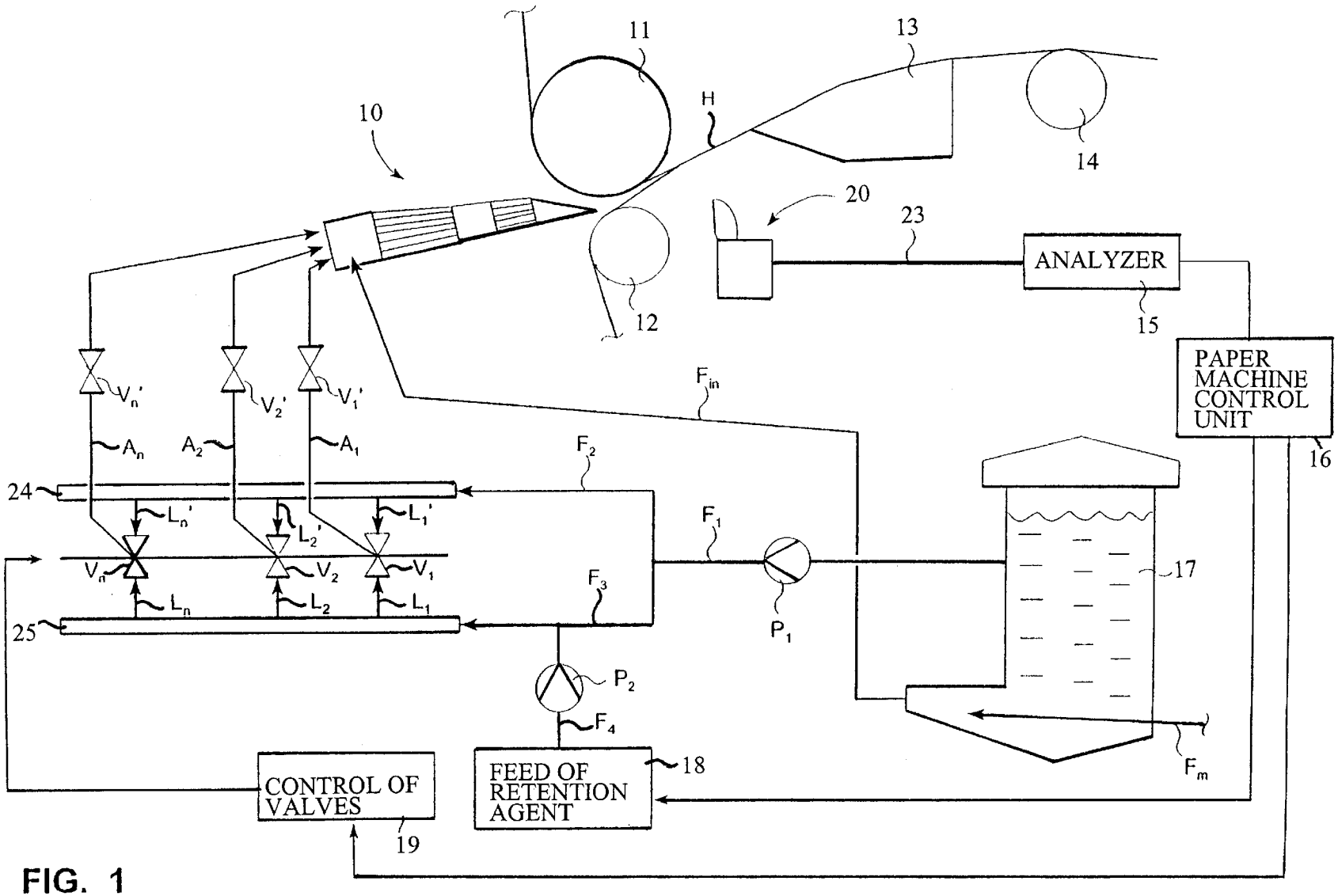
FIG. 1 is an illustration in the form of a block diagram of an embodiment of the retention profile measurement and control system in accordance with the present invention as applied to a dilution headbox.

FIG. 1 is an illustration in the form of a block diagram of the parts of a paper machine and of a system of measurement included in the system of regulation and control of the retention profile in an embodiment in accordance with the present invention. The stock suspension jet is discharged out of the slice opening of the headbox 10 into the forming gap between the forming rolls 11 and 12 and from the gap further onto the forming wire H. FIG. 1 also shows a suction box 13 and a guide roll 14. Below the forming wire H, a sample collecting equipment 20 is placed, by whose means samples are taken out of the white water departing from the wire H. The white water is recovered into the wire pit 17, from which it is passed back into the papermaking process, mainly to be used as dilution water for the headbox.

The high-consistency stock is fed into the wire pit 17 as a flow $F_m$, and from the wire pit 17 the high-consistency stock is passed to the headbox 10 as a flow $F_{in}$. From the wire pit 17, a flow $F_1$, is passed through a pump $P_1$, which flow is divided into flows $F_2$ and $F_3$. The white-water flow $F_2$ is passed into a dilution header 24. A retention agent feed unit 18 supplies a retention agent flow $F_4$, through a pump $P_2$ to be added to the flow $F_3$, which is passed further into a retention agent header 25.

From the dilution header 24 the flow $F_2$ is distributed to the valves $V_1 \ldots V_n$ through the respective lines $L_1' \ldots L_n$. From the retention agent header 25 the flow is distributed to the valves $V_1 \ldots V_n$ through the respective lines $L_1 \ldots L_n$. The valves $V_1 \ldots V_n$ are three-way valves, by whose means the retention profile and the dilution profile are regulated. The regulation of said profiles is carried out independently from one another. For example, if a recess is noticed in the retention profile, retention agent is added to that location. Owing to the improved retention, more fibres, fines and fillers remain on the wire, in which connection the basis weight is increased in this area. In such a case, dilution water is added to said area in order that the basis weight profile should remain uniform. The control for the valves $V_1 \ldots V_n$ is obtained from the valve control unit 19.

From the valves $V_1 \ldots V_n$ the stock flow is passed through the respective lines $A_1 \ldots A_n$ to the different positions of width in the headbox across the whole width of the headbox. The lines $A_1 \ldots A_n$ include ordinary throttle valves $V_1' \ldots V_n'$ for regulation of the flow quantities. In the embodiment shown, the valves $V_1 \ldots V_n$ are favourably valves to which it is possible to pass the flow portion $Q_1$ comprising the retention agent from the retention agent header 25 and the flow portion $Q_2$ comprising the dilution water alone from the dilution water header 24. The combined flow $Q_1+Q_2$ is passed further into the lines $A_1 \ldots A_n$ and further, through the valve $V_1' \ldots V_n'$ placed in each line, to the different positions of width in the headbox. By means of the valves $V_1 \ldots V_n$, the mixing ratio of the dilution flow passed from the dilution water header 24 to the flow containing retention agent and passed from the retention agent header 25, i.e. the retention ratio, is regulated. When the flow $Q_1$ is increased, the flow $Q_2$ is reduced by a corresponding amount, and the other way round. Thus, the sum flow $Q_1+Q_2$ remains invariable, and said combined flow is passed through the ordinary throttle valves $V_1' \ldots V_n'$ to the different positions of width in the headbox. By means of regulation of the valves $V_1' \ldots V_n'$, it is possible to regulate the flow quantity of the sum flow Q. $+Q_2$ and, thereby, the basis weight of the web at different positions of width with the retention ratio regulated by means of each particular valve $V_1 \ldots V_n$. A joint operation of the valves $V_1$ and $V_1'$ can also be accomplished, for example, by means of one valve, which is described in the FI Patent No. 92,229.

The device 20 for taking samples from the white water is favourably traversing, and by its means samples are taken from the white water preferably with uniform spacing across the entire width of the wire H. The sample collected from each cross-direction location is carried through a transfer pipe 23 to the white water analyzer 15, which determines the concentrations of solid matter and fillers present in the sample. The device for 20 taking samples can also be stationary (e.g. a pipe) so that it comprises sampling compartments opened one at a time for taking samples in the cross direction.

As a white water analyzer 15, it is possible to use, for example, a "Kajaani RM-200" analyzer, whose operation is based on optical on-line measurement from a constant flow of samples. The detector of the analyzer measures the depolarization, attenuation and backscattering and absorption at different wave lengths from laser light passing through the sample. In analyzing of the sample, it is also possible to use some other analyzer for determination of the properties of the white water.

The white water analyzer 15 transmits the data analyzed from the sample to the paper machine control unit 16, which uses the analyzed data for the control of the paper machine.

In the embodiment in accordance with the invention, the paper machine control unit 16 controls the retention agent feed unit 18 and the valve control unit 19.

Figure 2:
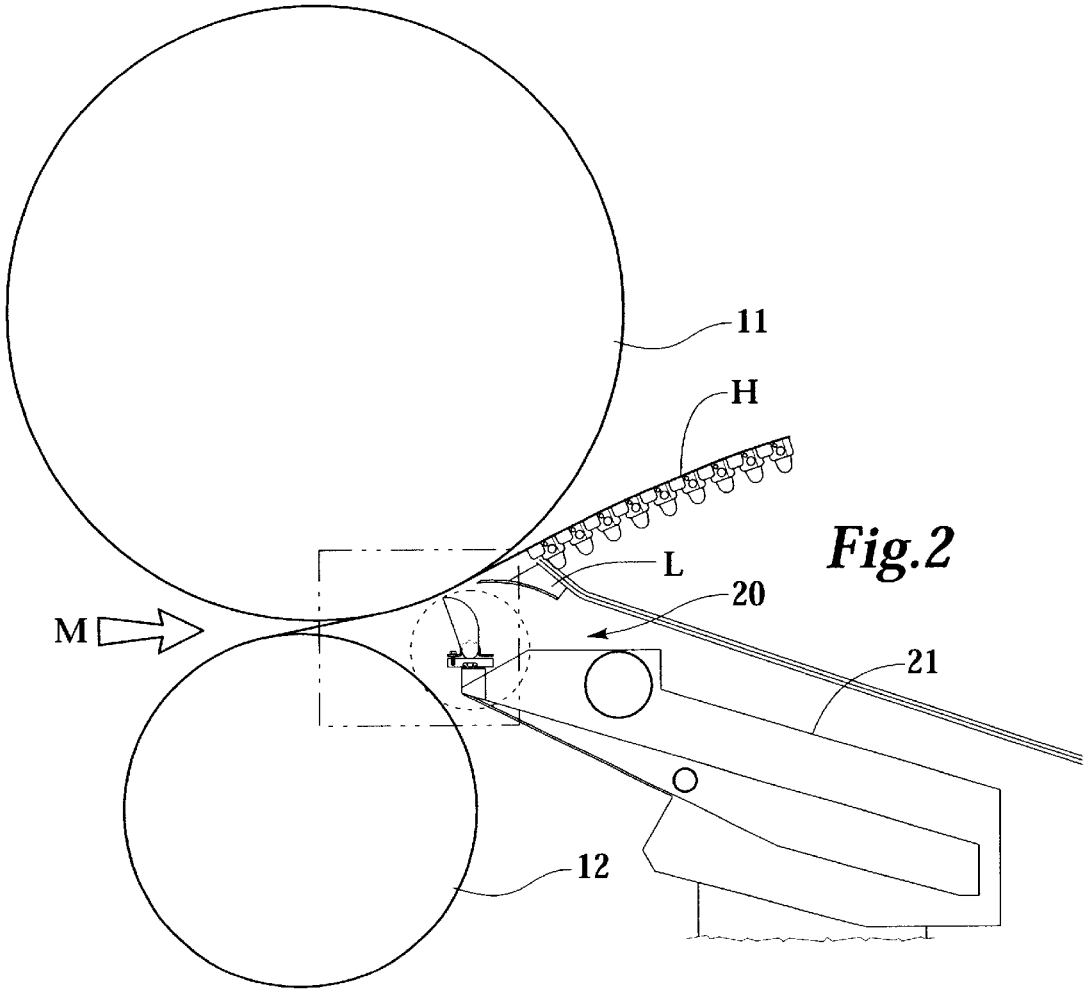
FIG. 2 is a general view of an arrangement of collecting of white water samples.

FIG. 2 illustrates the location of the traversing sampling unit 20 in the vicinity of the forming wire H and of the forming rolls 11 and 12. The stock M is fed in the direction indicated by the arrow between the forming rolls 11 and 12 and a ribbed shoe L. The carrier 21 of the traversing sampling head remains stationary at each sampling point for the time of collecting of the sample. Typically, the taking of a sample takes about 30 seconds, and samples are taken at intervals of 10 cm. The movement of the carrier 21 of the traversing sampling head is preferably synchronized, so that the sample is always taken from the same position of width in each series of measurement of the retention profile.

Figure 3:
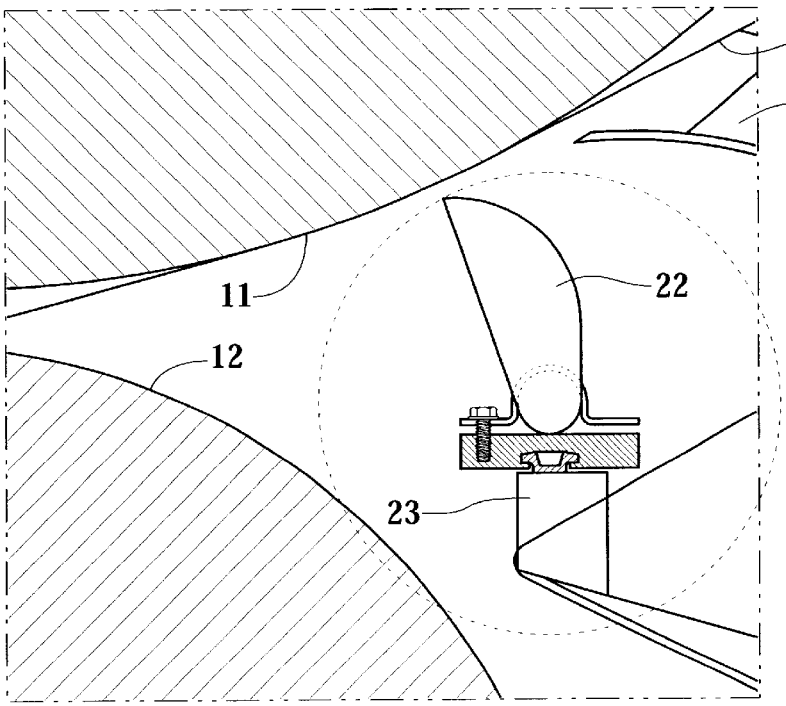
FIG. 3 is a detailed illustration of the arrangement of collecting of white water samples.

FIG. 3 illustrates the area of the rectangle drawn with a dashed line in FIG. 2, which figure shows a detail of the sample collecting trough 22. The collecting trough 22 is placed at a point which represents about 40 per cent of the water that is drained. The water sample passes from the collecting trough into a transfer pipe 23, along which it is passed to the analyzer 15.

The system of measurement of the retention profile is connected to each particular valve $V_1 \ldots V_n$ that regulates the mixing ratio (mixing ratio of retention agent) as a feedback connection so that from each point of width the measurement data are passed to the valve $V_1 \ldots V_n$ that regulates the retention profile at said point of width. After the valves $V_1 \ldots V_n$, in the discharge line $A_1 \ldots A_n$ departing from the valves, there can be a separate throttle valve $V_1 \ldots V_n$ which regulates the flow quantity and by whose means the basis weight of the web can be regulated additionally across the web width. Joint operation of the valves $V_1$, $V_1'$; $V_2$, $V_2'$ can also be accomplished by means of a single-valve solution in accordance with the FI Patent No. 92,229. By means of the regulation in accordance with the present invention, it is possible to provide a retention profile as straight as possible across the web width. Moreover, it is separately possible to regulate the filler profile. The device is also suitable for clearing up situations of problems, for example, in a situation in which the retention agent has been mixed incompletely or in which there are blocked portions or contaminations in the wire fabric.

Figure 4:
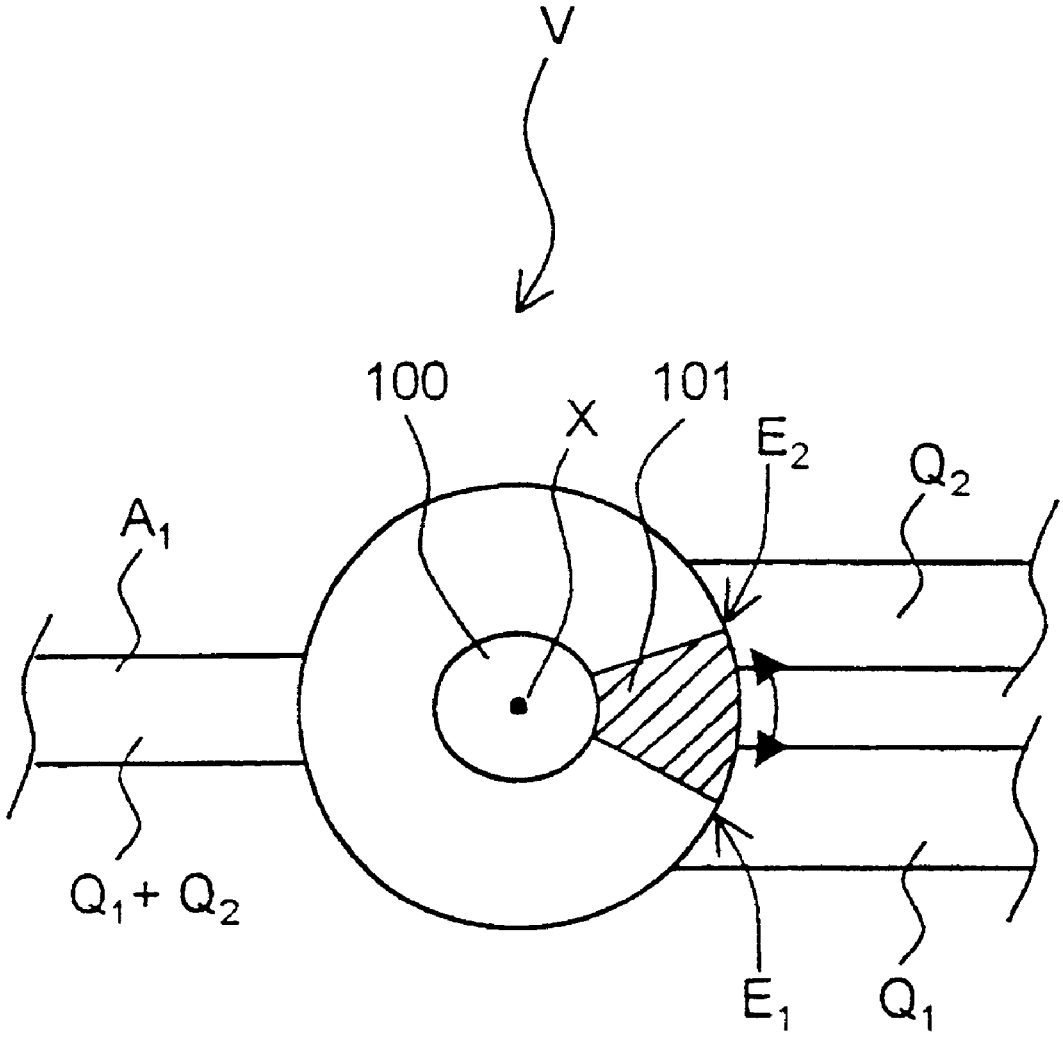
FIG. 4 is an exemplifying illustration of a valve construction that regulates the ratio of the retention agent in the flow.

FIG. 4 illustrates an exemplifying embodiment of a solution of a three-way valve as described in the FI Patent 92,229, which valve is suited for regulation of the retention agent in the present invention. The retention agent is passed, for example, into the liquid flow $Q_1$, and the flow $Q_2$, which may consist of pure water, is passed into the valve V while the covering part 101 pivoting on the spindle 100 regulates the coverages of the inlet openings $E_1$ and $E_2$. When one inlet opening E, is being opened, the other opening $E_2$ is being closed, or the other way round. In this way the flow quantity remains invariable, but the mixing ratio of the retention agent in the combined flow $Q_1+Q_2$ is regulated. Further, the valve V shown in the figure can be such that the covering part 101 and the spindle 100 can be shifted axially in the direction X, in which case, with a certain mixing ratio, it is also possible to regulate the flow quantity. Said property can be substituted for by means of the construction described above, in which separate throttle valves are employed after the three-way valve $V_1 \ldots V_n$.

In the following, the patent claims will be given, and the different details of the invention can show variation within the scope of the inventive idea defined in said patent claims and differ even to a considerable extent from what has been stated above by way of example only.

What is claimed is:

1. A method for measurement and regulation of the retention profile of the web in a paper/board machine, the method comprising the steps of:

taking a plurality of samples from white water drained from the web through the wire in the wire part of a paper/board machine, the samples being taken at positions spaced in a cross machine direction, wherein each of the samples of white water is taken from the water departing from a forming roll;

analyzing the plurality of samples in an analyzer to derive measurement results for each sample;

forming a retention profile from the measurement results; and using the retention profile to control the paper/board machine.

2. The method of claim 1 wherein the measurement results are used for regulation of the retention profile of the paper web.

3. The method of claim 1 wherein the samples are taken at particular positions, and further comprising the step of taking a successive series of white water samples at said particular positions.

4. The method of claim 1 wherein the retention profile is used for regulation of the contents of fibres, fines and fillers in the papermaking pulp.

5. The method of claim 1 wherein the step of using the retention profile to control the paper/board machine includes the step of regulating a feed of retention agent to different points spaced from one another in the cross machine direction in the headbox.

6. The method of the claim 5, wherein the retention agent is metered together with dilution water by valves.

7. A device for measurement and regulation of a retention profile of a web in a paper/board machine, the device comprising:

means for measuring the retention profile across the web width from different points of width of the web out of the white water drained from a wire part of the paper/board machine;

a headbox;

a plurality of liquid flow lines which communicate with points in the headbox which are spaced in a cross machine direction from one another, a flow of stock into the headbox, the plurality of liquid flow lines introducing a flow of liquid containing retention agent into the flow of stock to regulate the retention profile across the web width, and a first valve in each liquid flow line, each valve being adjustable to regulate the amount of retention agent being carried by each flow line, the valves being regulated on the basis of the measurement data obtained from measurement of the retention profile, wherein each of the plurality of first valves is a two-way valve in which a mixing ratio of two inlet flows is regulated, one of said inlet flows including the retention agent, wherein the mixing ratio is regulated so that, when one inlet flow is increased, tire other inlet flow is reduced by a corresponding amount, and the other way round, and that the combined flow is passed into the liquid flow line after the valve.

8. The device of claim 7 wherein each first valve is adjustable to regulate the amount of flow of material passing into the line which passes to a certain one of said points spaced in a cross machine direction within the headbox.

9. A device for measurement and regulation of a retention profile of a web in a paper/board machine, the device comprising:

means for measuring the retention profile across the web width front different points of width of the web out of the white water drained from a wire part of the paper/board machine;

a headbox;

a plurality of liquid flow lines which communicate with points in the headbox which are spaced in a cross machine direction from one another, a flow of stock into the headbox, the plurality of liquid flow lines introducing a flow of liquid containing retention agent into the flow of stock to regulate the retention profile across the web width, and a first valve in each liquid flow line, each valve being adjustable to regulate the amount of retention agent being carried by each flow line, the valves being regulated on the basis of the measurement data obtained from measurement of the retention profile; and a second valve positioned in each liquid flow line after the first valve, the second valves being Adjustable to regulate the flow quantity in each line.

10. A device for measurement and regulation of a retention profile of a web in a paper/board machine, the device comprising:

means for measuring the retention profile across the web width from different points of width of the web out of the white water drained from a wire part of the paper/board machine;

a headbox;

a plurality of liquid flow lines which communicate with points in the headbox which are spaced in a cross machine direction from one another, a flow of stock into the headbox, the plurality of liquid flow lines introducing a Low of liquid containing retention agent into the flow of stock to regulate the retention profile across the web width, and a first valve in each liquid flow line, each valve being adjustable to regulate the amount of retention agent being carried by each flow line, the valves being regulated on the basis of the measurement data obtained from measurement of the retention profile; and wherein the means for measuring the retention profile across the web width comprises:

an analyzer, a sample collecting device positioned beneath the wire, the sample collecting device positioned to take a sample from the water that has departed from the wire;

a carrier for the sample collecting device; and a sample transfer duct through which each sample is transferred to the analyzer for determining the retention profile.

11. The device of claim 10 wherein the sample collecting device is movable with the carrier in the cross machine direction of the web.

12. The device of claims 10 wherein the the content of fibres and fillers in each sample is analyzed by the analyzer by analysis of the white water sample which has drained from the wire.

13. A device for measurement and regulation of a retention profile of a web in a paper/board machine, the device comprising:

means for measuring the retention profile across the web width from different points of width of the web out of the white water drained from a wire part of the paper/board machine;

a headbox;

a plurality of liquid flow lines which communicate with points in the headbox which are spaced in a cross machine direction from one another, a flow of stock into the headbox, the plurality of liquid flow lines introducing a flow of liquid containing retention agent into the flow of stock to regulate the retention profile across the web width, and a first valve in each liquid flow line, each valve being adjustable to regulate the amount of retention agent being carried by each flow line, the valves being regulated on the basis of the measurement data obtained from measurement of the retention profile; and further comprising:

a wire pit positioned beneath the wire to collect white water;

a dilution header communicating with the plurality of liquid flow lines; and a flow connection for passing of dilution water from the wire pit to the dilution header, the dilution header being positioned upstream of the first valves.

14. The device of claim 13 further comprising:

a retention agent header communicating with the plurality of liquid flow lines;

a flow connection for passing of dilution water from the wire pit to the retention agent header, the retention agent header being positioned upstream of the first valves;

a retention agent supply unit; and a flow connection for passing of retention agent from the retention agent supply unit to the retention agent header.

15. A device for measurement and regulation of a retention profile of a web in a paper/board machine, the device comprising:

means for measuring the retention profile across the web width from different points of width of the web out of the white water drained from a wire part of the paper/board machine;

a headbox;

a plurality of liquid flow lines which communicate with points in the headbox which are spaced in a cross machine direction from one another, a flow of stock into the beadbox, the plurality of liquid flow lines introducing a flow of liquid containing retention agent into the flow of stock to regulate the retention profile across the web width, and a first valve in each liquid flow line, each valve being adjustable to regulate the amount of retention agent being carried by each flow line, the valves being regulated on the basis of the measurement data obtained from measurement of the retention profile; and further comprising:

a wire pit positioned beneath the wire to collect white water;

a retention agent header communicating with the plurality of liquid flow lines;

a flow connection for passing of dilution water from the wire pit to the retention agent header, the retention agent header being positioned upstream of the first valves;

a retention agent supply unit; and a flow connection for passing of retention agent from the retention agent supply unit to the retention agent header.

16. The device of the claim 15 further comprising a valve control unit which controls the first valves, and wherein a paper machine control unit controls the valve control unit and the retention agent supply unit.

17. A device for measurement and regulation of a retention profile of a web in a paper/board machine, the device comprising:

means for measuring the retention profile across the web width from different points of width of the web out of the white water drained from a wire part of the paper/board machine;

a headbox;

a plurality of liquid flow lines which communicate with points in the headbox which are spaced in a cross machine direction from one another, a flow of stock into the headbox, the plurality of liquid flow lines introducing a flow of liquid containing retention agent into the flow of stock to regulate the retention profile across the web width, and a first valve in each liquid flow line, each valve being adjustable to regulate the amount of retention agent being carried by each flow line, the valves being regulated on the basis of the measurement data obtained from measurement of the retention profile; and wherein a second valve is positioned in each of said flow lines, said second valves being positioned to permit regulation of a flow of a quantity of dilution water through said flow lines.

18. A method for forming a web in a papermaking machine having a headbox which discharges stock onto a moving wire, the method comprising the steps of:

discharging stock on to the wire from the headbox, wherein liquid which is not retained on the wire and passes through the wire comprises white water;

taking samples of the white water that passes through the wire at a plurality of web locations which are spaced from each other in a cross machine direction; measuring each sample to measure the properties of the white water at each of said web locations;

introducing a flow of stock into the headbox; and introducing a plurality of second flows into the headbox, the second flows discharging into the beadbox at a plurality of positions spaced from each other in the cross machine direction, each second flow being controlled to adjust the amounts of dilution water and retention agent in each second flow, the proportions of dilution water and retention agent being controlled in response to the measured properties of the white water samples;

wherein the step of taking samples of the white water further comprises the steps of:

positioning a sample head at a first one of said plurality of web locations in the cross machine direction, and retaining the sample head stationary during the time of collecting a first sample;

advancing the sample head in the cross machine direction a predetermined distance to bring the sample head to a second one of said plurality of web locations in the cross machine direciton, and retaining the sample head stationary during the time of collecting a second sample; and continuing to advance the sample head and hold the sample head stationary until each of said plurality of web locations has been sampled; and repeating the above steps.

19. The method of claim 18 wherein each of the plurality of positions in the headbox into which a second flow is introduced corresponds to a particular one of the web locations where a sample is taken, and a feedback connection is established between the measurements of the samples, and the amount of dilution water and retention agent introduced into the headbox to modify the flows into the headbox at each headbox position in response to the measured properties of the white water of the sample taken at a corresponding web location.

20. The method of claim 18 further comprising the steps of:

regulating the flow quantity of each second flow to regulate the basis weight of the web being formed on the papermaking machine at different positions in the cross machine direction.

21. A papermaking machine comprising:

a headbox;

a wire extending downstream from the headbox, wherein stock is discharged from the headbox onto the wire, and wherein a web is formed on the wire, and stock which is not retained on the wire passes through the wire as white water;

a sampling device positioned beneath a plurality of locations which are spaced in the cross machine direction along the wire, the sampling device positioned to collect white water samples at each of the plurality of locations;

a transfer pipe which communicates each white water sample to a white water analyzer which determines the white water in each sample;

a paper machine control unit which receives data from the analyzer concerning each sample;

a plurality of headbox supply lines which discharge into the headbox, the headbox supply lines discharging into the headbox at headbox locations which are spaced from one another in a cross machine direction;

a supply of dilution liquid;

a retention agent feed unit; and wherein the supply of dilution liquid and the retention agent feed unit are connected to communicate dilution liquid and retention agent to each of the headbox supply lines, the quantity of dilution liquid and retention feed so communicated being controlled by the paper machine control unit in response to the white water properties measured in the samples.

22. The papermaking machine of claim 21 wherein the sampling device is mounted for traversing movement to move between each of the plurality of locations.

23. The papermaking machine of claim 21 wherein each of the plurality of headbox locations into which the supply lines discharge corresponds to a particular one of the web locations where a sample is taken, and a feedback connection is established between the determination of the properties of the white water of the samples, and the amount of dilution water and retention agent introduced into the headbox to modify the flows into the headbox at each headbox location in response to the white water properties measured in a sample taken at a corresponding web location.

24. The papermaking machine of claim 21 further comprising:

a dilution liquid header which receives dilution liquid from the supply of dilution liquid;

a retention agent header which receives retention agent from the retention agent feed unit;

a plurality of first valves, one in each of the headbox supply lines, the first valves being controlled by the paper machine control unit to control the quantity of flow into the headbox through the headbox supply lines; and a plurality of second valves, each second valve being connected to one of the plurality of headbox supply lines at a position upstream of the first valve located in that headbox supply line, each second valve being connected between the retention agent header and the dilution liquid header, the second valves being controllable by the paper machine control unit to adjust the quantity of dilution liquid and retention agent introduced into each headbox supply line.

* * * * *

UNITED STATES PATENT AND TRADEMARK OFFICE

CERTIFICATE OF CORRECTION

PATENT NO. : 6,471,827 B2
DATED : October 29, 2002
INVENTOR(S) : Juhana Lumiala et al.

It is certified that error appears in the above-identified patent and that said Letters Patent is hereby corrected as shown below:

Column 4,
Line 24, change "Q." to -- $Q_1$ --.

Column 5,
Line 38, change "E," to -- $E_1$ --.

Column 6,
Line 57, change "front" to -- from --.

Column 7,
Line 8, change "Adjustable" to -- adjustable --.
Line 23, change "Low" to -- flow --.

Column 8,
Line 36, "beadbox" to -- headbox --.

Signed and Sealed this

Eighteenth Day of February, 2003

JAMES E. ROGAN
*Director of the United States Patent and Trademark Office*